United States Patent [19]

Aktay et al.

[11] 3,992,266

[45] Nov. 16, 1976

[54] RECOVERY OF COAL FINES FROM PREHEATER

[75] Inventors: Ali I. Aktay, Munster; Michael O. Holowaty, Crown Point, both of Ind.

[73] Assignee: Inland Steel Company, Chicago, Ill.

[22] Filed: July 24, 1975

[21] Appl. No.: 598,843

[52] U.S. Cl. ..... 201/8; 201/9; 201/23; 201/41; 201/42

[51] Int. Cl.[2] ..... C10B 53/04

[58] Field of Search ..... 201/3, 4, 7, 8, 9, 21, 201/22, 23, 32, 33, 36, 37, 41, 42, 43

[56] References Cited

UNITED STATES PATENTS

| | | | |
|---|---|---|---|
| 3,140,241 | 7/1964 | Work et al. | 201/9 X |
| 3,506,745 | 4/1970 | Juel et al. | 201/9 X |

OTHER PUBLICATIONS

D. G. Marting et al., "Pipeline Charging Preheated Coal to Coke Ovens", U.N. Economic Commission for Europe Symposium on Developments in European and World Markets for Coking Coal and Coke, Rome, Italy (Mar. 27, 1973).

*Primary Examiner*—Joseph Scovronek
*Attorney, Agent, or Firm*—Merriam, Marshall, Shapiro & Klose

[57] ABSTRACT

Coal particles are heated and further particulized at a preheat stage employing a preheat gas. Some of the finer coal particles are puffed up by the preheating step. Most of the preheated coal particles are separated from the preheat gas, but some of the finer coal particles remain with the preheat gas. The coal particles separated from the preheat gas are oiled and eventually transported by a carrier gas through a pipeline into a coke oven. The preheat gas and the finer coal particles remaining therewith are separated from each other utilizing a wet scrubber at which the finer coal particles undergo flocculation. Oil vapor vented from the coal particles headed for the coke oven is directed to the wet scrubber to aid in the flocculating step. The flocculated coal particles are separated from the scrubber liquid in a flotation cell. The overflow from the flotation cell is filtered, and the filter cake comprising coal particles is employed as a fuel. At least some of the underflow from the flotation cell is recycled as scrubber liquid to the wet scrubber. The liquid from the filtering step is employed to precipitate, in a charging main, fine coal particles discharged with carrier gas into the charging main during charging of the coke oven.

9 Claims, 1 Drawing Figure

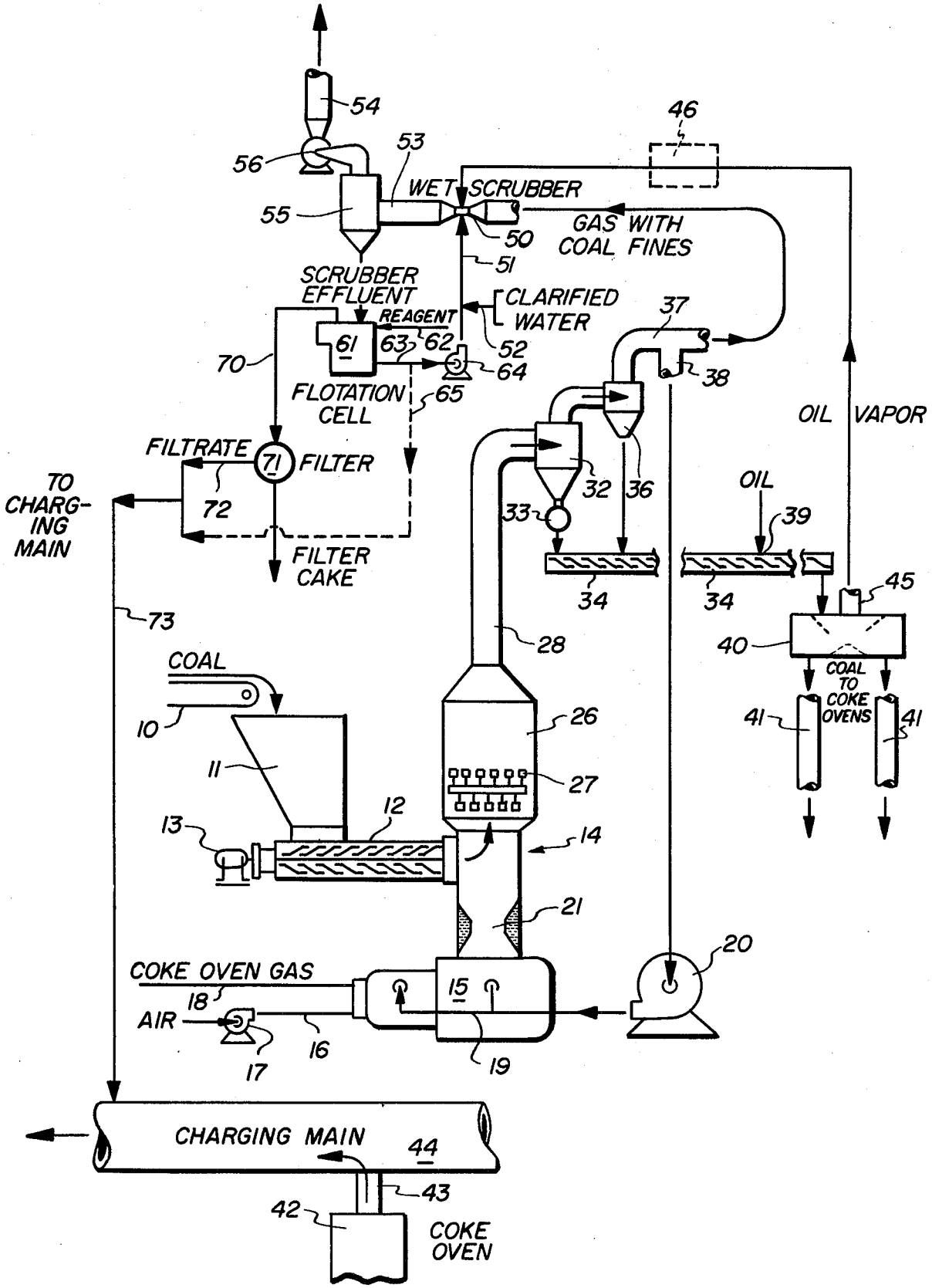
54
46
53
56
WET SCRUBBER
55
GAS WITH
COAL FINES
50
51
SCRUBBER
EFFLUENT
CLARIFIED
WATER
REAGENT
37
61
63
62
52
70
64
38
FLOTATION
CELL
65
OIL VAPOR
FILTRATE
71
FILTER
TO
CHARG-
ING
MAIN
72
32
36
OIL
33
39
FILTER
CAKE
34
34
45
73
28
40
COAL
COAL
TO
COKE
OVENS
10
26
41
41
11
27
12
13
14
21
20
COKE OVEN GAS
15
18
AIR
16
17
19
CHARGING MAIN
44
43
42
COKE
OVEN

RECOVERY OF COAL FINES FROM PREHEATER

BACKGROUND OF THE INVENTION

The present invention relates generally to methods for separating fine coal particles from a mixture containing fine coal particles and a liquid, and more particularly to methods for separating fine coal particles which have previously been subjected to a preheating operation preparatory to the pipeline charging of coal particles into coke ovens.

In the pipeline charging of coal particles into coke ovens, the coal is subjected to a combined particulizing and preheating operation preparatory to conveying through a pipeline to a coke oven. It is desirable to separate the coal particles from the preheat gas upstream of the coke ovens. The separation of coal particles from preheat gas is normally performed with cyclone separators. The preheated coal particles include both relatively coarse and relatively fine coal particles, some of the latter being smaller than 325 mesh. Virtually all of the relatively coarse coal particles and most of the relatively fine coal particles descend through the bottom of the cyclone separators. The gas is removed through the top of these cyclone separators, and this off gas contains some of the relatively fine coal particles. It is desirable to recover these fine coal particles from the gas to utilize the fuel value of the coal and to avoid air pollution. These fine coal particles are separated from the preheat gas with a liquid at a wet scrubber followed by a second cyclone separating stage. The scrubber effluent recovered at the second cyclone separating stage contains a mixture of the precipitating liquid and the fine coal particles, and this effluent is introduced into a flotation cell to separate the fine coal particles from the scrubber liquid.

Problems arise in obtaining a satisfactory recovery of the fine coal particles at the flotation cell.

SUMMARY OF THE INVENTION

The present invention employs techniques for maximizing recovery of the fine coal particles at the flotation cell. The present invention also embodies maximum utilization of the products recovered at the flotation cell and elsewhere in the fine coal particle recovery system. The method also avoids recycling the recovered fine coal particles back to the preheating stage because many of them would merely be separated with the gas again at the cyclone separating stage following preheating, so that preheating them again would be wasteful. In addition, water and tar are unavoidably present in the recovered fine coal particles, and these could be both wasteful and troublesome in the operation of the preheating unit.

Coal particles having a size smaller than 200 mesh are normally not susceptible to separation by flotation. As previously noted, coal particles finer than 325 mesh are produced during particulization of the coal at the preheating stage. The present invention comprises a combination of techniques, including puffing of some of the fine coal particles at the preheating stage and flocculation of the fine coal particles at the wet scrubber, for increasing the recovery of fine coal particles at the flotation cell. As an aid in the flocculation of the fine coal particles, the present invention introduces, at the wet scrubber, oil recovered as vapor from oil added, as a dust-preventing and densifying measure, to the coal particles following separation thereof from the preheat gas at the cyclone separators.

The bulk of the liquid separated from the fine coal particles as the flotation underflow is directed to the wet scrubber. Optionally, a smaller volume fraction of the flotation cell underflow is directed to the charging main of the coke ovens. During the charging step when the finely sized and preheated coal is charged by pipeline into the coke oven, there is discharged into the charging main a mixture of steam, coal gas, and fine coal particles which is known as carry-over. The liquid directed into the charging main precipitates the fine coal particles from the gas in the charging main to facilitate subsequent separation and recovery of the fine coal particles.

Other features and advantages are inherent in the method claimed and disclosed or will become apparent to those skilled in the art from the following detailed description in conjunction with the accompanying diagrammatic drawings.

BRIEF DESCRIPTION OF THE DRAWINGS

The sole FIGURE in the drawing is a flow sheet illustrating diagrammatically an embodiment of a method in accordance with the present invention.

DETAILED DESCRIPTION OF PREFERRED EMBODIMENT

Pieces of coal are carried by conveyor 10 into a feed hopper 11 feeding into a closed auger 12 driven by a motor 13 for introducing the coal into a preheating stage indicated generally at 14.

Also introduced into preheating stage 14 is a preheat gas produced at a furnace 15 located below preheating stage 14. Coke oven gas is introduced into furnace 15 through a line 18, air is introduced into furnace 15 by a blower 17 through a line 16, and recycled preheat gas with some coal fines is introduced into furnace 15 by a blower 20 and a line 19. The coke oven gas, air and coal fines are combusted in furnace 15 to produce the preheat gas which is directed upwardly through a venturi section 21 into the preheating stage 14.

The size of the coal pieces and the velocity of the preheat gas are such that the coal pieces are conveyed by the preheat gas upwardly into a chamber 26 containing a hammermill 27 in the lower part thereof for particulizing or dividing the coal pieces. The coal is preheated and particulized to provide a mixture of preheated coal particles suspended in hot preheat gas, and this mixture exits from the top of chamber 26 into an upwardly extending conduit 28.

This mixture of preheated coal particles and hot preheat gas is passed through a first cyclone separating stage comprising a primary cyclone separator 32 and one or more secondary separators 36 to separate the mixture into a first portion consisting essentially of coal particles and a second portion containing the gas and some of the relatively finer coal particles. Coal particles are separated from the gas in primary cyclone separator 32 and pass downwardly through a metering valve 33 into an enclosed conveyor, such as an auger 34, which carries the coal particles to a distribution bin 40.

Secondary cyclone separator 36 is located immediately downstream of primary cyclone separator 32 to further separate, from the effluent exiting through the top of primary cyclone separator 32, coal particles which were carried over from first cyclone separator 32. The coal particles separated at secondary cyclone separator 36 are directed to auger 34 and carried to distribution bin 40.

Exiting from the top of secondary cyclone separator 36 through a conduit 37 is the second portion of the preheated mixture containing the preheat gas and relatively fine coal particles. Conduit 37 leads to a wet scrubber 50. A branch line 38 from conduit 37 conducts recycled preheat gas and fine coal particles to blower 20 for feeding through line 19 into furnace 15.

Also leading into wet scrubber 50 is a line 51 carrying scrubbing liquid. A function of wet scrubber 50 is to precipitate the fine coal particles from the gas in the second portion of the preheated mixture. In addition, the fine coal particles are flocculated in the wet scrubber, as will be described in greater detail below. The output from the wet scrubber passes through a conduit 53 into a cyclone separator 55 for separation into a first part containing the gas and a second part or scrubber effluent comprising the flocculated fine coal particles and the liquid from the wet scrubber. The gas passes upwardly and outwardly from cyclone separator 55 through an exhaust conduit 54 communicating with a blower 56 communicating with the top of cyclone separator 55.

The flocculated fine coal particles and the scrubber liquid are fed from cyclone separator 55 into a flotation cell 61. Also introduced into flotation cell 61, through a line 62, is a conventional coal flotation reagent such as kerosene added in the ratio of one pint per ton of coal. In the flotation cell, the scrubber effluent is separated into an overflow containing the flotated fine coal particles and an underflow containing the scrubber liquid. The underflow, containing the scrubber liquid is pumped through a line 63 by a pump 64 for recycling as scrubbing liquid through line 51 to wet scrubber 50. Preferably, clarified water is also introduced into line 51, as make-up scrubbing liquid.

The overflow from flotation cell 61, containing the flocculated fine coal particles, is passed through a line 70 to a filter 71, of conventional construction, to separate the flocculated coal particles from the liquid therein.

The liquid filtrate from filter 71 is removed through a line 72 communicating with a line 73 leading to the charging main 44 of the coke ovens. Optionally, additional liquid to the charging main is provided through a line 65 having its exit end communicating with line 73 and its entry end communicating with the bottom of the flotation cell to receive a portion of the underflow from the flotation cell.

The filter cake from filter 71 is removed and stockpiled for use as a fuel for steam boilers, for example. Neither the overflow from the flotation cell nor the filter cake is recycled to the preheating stage because at least some of the fine coal particles therein would merely again undergo separation at the first cyclone separating stage 32, 36. The heat which would otherwise be consumed in preheating these unrecycled fine coal particles is therefore available for use in preheating fresh coal particles which go to the coke ovens.

The coal particles contained in distribution bin 40 are fed into pipelines 41 leading to coke ovens 42 through connections not shown. The coal particles are conveyed to the coke ovens through the pipelines utilizing a conveying gas such as steam.

At the time the coal particles enter the coke oven there are, unavoidably, some fine coal particles present together with coarser coal particles. The coarser coal particles introduced into the coke oven remain there, but there is an unavoidable discharge, during the charging step, of conveying gas (steam) and some of the finer coal particles through an outlet 43 into charging main 44.

The liquid introduced into charging main 44 from line 73 precipitates the fine coal particles discharged into the charging main from coke oven 42. The resulting mixture of liquid and fine coal particles in the charging main is carried to a treatment plant (not shown) for separating the two components of the mixture.

As previously indicated, enclosed auger 34 carries the relatively coarse coal particles from first cyclone separating stage 32, 36 to distribution bin 40. Oil is introduced into auger 34, at location 39, as a dust-controlling and densifying measure. This oil may be of a type conventionally used to control the dust and density of coking coal, a common expedient.

The pressure in distribution bin 40 is lower than the pressure within enclosed auger 34 so that there is a flashing off of oil vapor from the coal particles in distribution bin 40. This oil vapor is vented from bin 40 into a conduit 45 and carried therein to wet scrubber 50 where it is mixed with the other ingredients entering the wet scrubber. Optionally, the oil vapor is introduced into a condensate tank 46, and the oil-containing liquid from condensate tank 46 is introduced into wet scrubber 50.

Referring again to the flotation step at flotation cell 61, separation of coal particles by flotation usually requires coal particles no smaller than 200 mesh. However, some of the coal is particulized to a size smaller than 325 mesh at chamber 26, and the fine coal particles removed with the preheat gas at the first separating stage through conduit 37 includes particles having a size smaller than 325 mesh. Nevertheless it is possible to separate these fine coal particles at flotation cell 61 because of features embodied in the method of this invention. These features include (1) the puffing of the fine coal particles at preheating stage 14 and (2) the flocculation of the fine coal particles at wet scrubber 50, utilizing the oil flashed off at distribution bin 40 as an aid in the flocculation of the fine coal particles.

Puffing of the fine coal particles at preheating stage 14 occurs as follows. Coal introduced into the preheating stage is at ambient temperature. The coal is particulized and subjected there to a hot gas blast having a temperature in the range 1200°–1600° F., and this causes a very rapid heat up of the coal particles. The finer the coal particle, the more rapid the heat up. As previously noted, the coal particles are suspended in the hot gas stream; and the individual suspended coal particles are unconfined by adjacent coal particles. The rapid heat up and lack of confinement causes puffing of the fine coal particles akin to the puffing of popcorn. If the preheating step were performed in such a manner as to confine the fine coal particles too closely together, the particles would fuse into a mass rather than puff up.

Some of the puffed up fine coal particles eventually arrive at flotation cell 61. A puffed up fine coal particle has a volume sufficient to enable it to be separated by flotation. Unpuffed fine coal particles which were not flotatable can become so when they are puffed up.

The puffed up particles have a large, irregular surface area on which unpuffed fine coal particles become wedged or otherwise adhere. This occurs at wet scrubber 50 and is the flocculation step to which previous mention was made. Flocculation permits flotation of the otherwise unflotatable, unpuffed fine coal particles.

Another factor in the flocculation of the fine coal particles is the oil vented from distribution bin 40. The oil acts as a flocculating agent. A typical embodiment of oil utilized for this purpose is a hydrocarbon-type heavy residual oil commercially known as No. 6 or Bunker C, and this is added to auger 34 at the rate of one and one-half gallons of oil per ton of coal. Alternatively, one may employ a heavy asphaltic oil, solid at room temperature and heated to a liquid state for application to the coal particles. Such oils include those having a melting point in the range 250°–325° F and viscosities greater than 1500 centipoise at 300° F.

During the preheating step, tar and oil may be generated from the coal undergoing preheating, and at least some of this tar and oil is carried over to the wet scrubber 50 and has the same positive effect on flocculation as does the oil vented from bin 40. If the amount of oil desired for flocculation at wet scrubber 50 is not obtainable by venting from bin 40, a flocculating agent (e.g., oil) can be added at wet scrubber 50 from a reservoir or storage tank (not shown).

Following are some typical parameters involved in a typical commercial-scale operation.

The size distribution of coal particles introduced into preheating stage 14 are given in Table I.

Table I

| Tyler Mesh | Frequency % | Accumulative Frequency % |
|---|---|---|
| ½" | 2.9 | 2.9 |
| ¼" | 6 | 8.9 |
| 6 | 15.6 | 24.5 |
| 10 | 18.1 | 42.6 |
| 28 | 25.7 | 68.3 |
| 48 | 11.2 | 79.5 |
| 100 | 8.2 | 87.7 |
| 200 | 5.5 | 93.2 |
| −200 | 6.8 | 100 |

The coal is introduced into the preheating stage at a feed rate in the range 100–130 tons an hour.

The feed rate of the preheat gas is approximately 50,000 CFM at a 130 ton an hour coal feed rate. If the coal feed rate is changed, the composition of the feed ingredients into the preheat gas also changes, e.g., when the coal feed rate is reduced, recycled gas is increased while coke oven gas and air is reduced.

The velocity of the preheat gas at venturi section 21 is 80 feet per second, and the temperature there is 1400° F.

90% of the coal particles are captured by primary cyclone separator 32, and an additional 9.5% of the coal particles are captured by secondary cyclone separator. 0.5% of the coal particles escape with the gas through conduit 37, going either to wet scrubber 50 or with the recycled preheat gas to furnace 15.

The size distribution of coal particles captured at primary cyclone separator 32 is given in Table II.

Table II

| Tyler Mesh | Frequency % | Accumulative Frequency % |
|---|---|---|
| ¼" | 4.7 | 4.7 |
| 6 | 13.7 | 18.4 |
| 10 | 21.4 | 39.8 |
| 28 | 32.8 | 72.6 |
| 48 | 12.9 | 85.5 |

Table II-continued

| Tyler Mesh | Frequency % | Accumulative Frequency % |
|---|---|---|
| 100 | 7.2 | 92.7 |
| 200 | 4.2 | 96.9 |
| 270 | 1.2 | 98.1 |
| 325 | 0.5 | 98.6 |
| 400 | 0.4 | 99.0 |
| −400 | 1.0 | 100 |

The size distribution of coal particles captured at separator 36 is given at Table III.

Table III

| Tyler Mesh | Frequency % | Accumulative Frequency % |
|---|---|---|
| 48 | 0.2 | 0.2 |
| 100 | 2.9 | 3.1 |
| 200 | 48.7 | 51.8 |
| 270 | 47.6 | 99.4 |
| 325 | 0.4 | 99.8 |
| 400 | 0.1 | 99.9 |
| −400 | 0.1 | 100 |

The size distribution of coal particles fed into auger 34 is given in Table IV.

Table IV

| Tyler Mesh | Frequency % | Accumulative Frequency % |
|---|---|---|
| ¼" | 0.4 | 0.4 |
| 6 | 2.8 | 3.2 |
| 10 | 8.3 | 11.5 |
| 28 | 25.4 | 36.9 |
| 48 | 19.1 | 56.0 |
| 100 | 16.2 | 72.2 |
| 200 | 12.8 | 85.0 |
| 270 | 5.0 | 90.0 |
| 325 | 3.0 | 93.0 |
| 400 | 5.3 | 98.3 |
| −400 | 1.7 | 100 |

The size distribution of coal particles carried with the gas to wet scrubber 50 is 58.7% less than 20 microns, and 85.7% less than 44 microns (about 325 mesh). The fine coal particles discharged from the coke oven into the charging main at the time of the charging step tend to agglomerate. Their size distribution, after separation from the precipitating liquid or charging liquor, on a wet screen analysis, is given in Table V.

Table V

| Tyler Mesh | Frequency % | Accumulative Frequency % |
|---|---|---|
| 20 | 36.8 | 36.8 |
| 50 | 36.0 | 72.8 |
| 100 | 14.2 | 87.0 |
| 325 | 13.0 | 100 |

What is claimed is:

1. In a method for charging coal particles into a coke oven, the steps of:

introducing coal into a preheating stage without recycling coal previously removed from said preheating stage;

introducing hot gas into said preheating stage;

preheating and particulizing said coal at said preheating stage;

removing, from said preheating stage, a mixture of coal particles and hot gas;

passing said mixture through a first cyclone separating stage to separate said mixture into a first portion consisting essentially of coal particles and a second portion containing said gas and relatively fine coal particles;

transporting said first portion to a bin containing coal particles for charging into said coke oven;

charging said coal particles from said bin into said coke oven;

passing said second portion through a wet scrubber;

introducing a scrubbing liquid at said wet scrubber;

flocculating said fine coal particles, contained in said second portion, at said wet scrubber;

introducing anti-dusting hydrocarbon liquid onto the coal particles of said first portion, during said transporting step;

venting, from said coal particles, hydrocarbon vapor generated after said hydrocarbon-introducing step and transporting said vented hydrocarbon vapor to said wet scrubber;

introducing said hydrocarbon vapor into said second portion at said wet scrubber to aid in said flocculation of the fine coal particles;

and passing the output from said wet scrubber through a second cyclone separating stage to separate said output into a first part containing said gas and a second part or scrubber effluent containing said flocculated fine coal particles and the liquid from said wet scrubber.

2. In a method as recited in claim 1 wherein said second portion entering said wet scrubber comprises fine coal particles smaller than 200 mesh.

3. In a method as recited in claim 2 wherein said second portion comprises fine coal particles smaller than 325 mesh.

4. In a method as recited in claim 1 wherein:

said coal introduced into said preheat stage is at ambient temperature;

said coal is subjected to a temperature in the range 1200°–1600° F at said preheating stage;

said preheating step comprises heating coal particles in a hot gas stream in which said coal particles are unconfined by adjacent coal particles to permit puffing of at least some of said coal particles during said preheating step;

said fine coal particles in said second portion comprising said puffed coal particles.

5. In a method as recited in claim 1 and comprising:

passing said second part of the scrubber output into a flotation cell to separate the second part into an overflow containing said flocculated fine coal particles and an underflow containing said scrubber liquid;

and recycling liquid from said underflow to said wet scrubber.

6. In a method as recited in claim 5 and comprising:

introducing liquid from said flotation cell underflow into said charging main of said coke oven to aid in the precipitation of said coal particles discharged thereinto.

7. In a method as recited in claim 1 wherein said coke oven has a charging main and fine coal particles are discharged from the coke oven into said charging main during said charging step, said method comprising the further steps of:

passing said second part of the scrubber output into a flotation cell to separate the second part into an overflow containing said flocculated fine coal particles and an underflow containing said scrubber liquid;

filtering the overflow from said flotation cell to separate the coal particles therein from the liquid therein;

and introducing the liquid separated at said filtering step into the charging main of said coke oven to precipitate said coal particles discharged into the charging main from the coke oven during said charging step.

8. In a method as recited in claim 7 and comprising:

introducing liquid from said flotation cell underflow into said charging main of said coke oven to aid in the precipitation of said coal particles discharged thereinto.

9. In a method as recited in claim 1 and comprising avoiding recycling, to said preheating stage, of the coal particles separated from said scrubber effluent.

* * * * *